United States Patent [19]

Kirkpatrick et al.

[11] Patent Number: 4,688,992

[45] Date of Patent: Aug. 25, 1987

[54] BLADE PLATFORM

[75] Inventors: Ralph A. Kirkpatrick, Mason; Kenneth Willgoose, Middletown; Omer D. Erdmann, Cincinnati, all of Ohio

[73] Assignee: General Electric Company, Cincinnati, Ohio

[21] Appl. No.: 694,889

[22] Filed: Jan. 25, 1985

[51] Int. Cl.[4] ..... F01D 5/30

[52] U.S. Cl. ..... 416/215; 416/191; 416/248

[58] Field of Search ..... 416/215, 216, 217, 218, 416/219 R, 220 R, 193 A, 248, 198 A, 190, 191; 415/138, 139, 190, 189

[56] References Cited

U.S. PATENT DOCUMENTS

| | | | |
|---|---|---|---|
| 785,066 | 3/1905 | Farwell | 415/216 |
| 1,073,623 | 9/1913 | Owen et al. | 416/191 |
| 1,494,781 | 5/1924 | Gilson | 416/215 |
| 2,575,237 | 11/1951 | Sollinger et al. | 416/198 A X |
| 2,654,565 | 10/1953 | Feilden | 416/215 |
| 2,673,709 | 3/1954 | Barnes | 416/248 |
| 2,738,126 | 3/1956 | Edwards | 416/215 |
| 2,833,463 | 5/1958 | Morley | 415/218 |
| 2,834,573 | 5/1958 | Stalker | 253/39 |
| 2,861,823 | 11/1958 | Perry | 416/198 A X |
| 2,921,777 | 1/1960 | Frankel | 416/215 |
| 2,925,216 | 2/1960 | Stalker | 230/122 |
| 2,925,250 | 2/1960 | Whitehead | 416/215 |
| 2,955,799 | 10/1960 | Oickle | 416/190 |
| 3,024,968 | 3/1962 | Payne et al. | 415/218 |
| 3,107,897 | 10/1963 | Varadi et al. | 253/78 |
| 3,120,277 | 2/1964 | Brown et al. | 416/215 |
| 3,203,666 | 8/1965 | West | 416/215 |
| 3,303,998 | 2/1967 | Koff et al. | 415/218 X |
| 3,326,523 | 6/1967 | BoBo | 415/218 |
| 3,442,442 | 5/1969 | Seiwert | 415/218 X |
| 3,471,127 | 10/1969 | Emmerson | 416/216 |
| 3,778,185 | 12/1973 | Plowman et al. | 415/217 |
| 3,923,420 | 12/1975 | Chifos | 416/193 A X |
| 3,986,789 | 10/1976 | Pask | 415/189 X |
| 4,365,933 | 12/1982 | Langer et al. | 415/217 X |
| 4,415,310 | 11/1983 | Bouiller et al. | 416/95 |
| 4,462,756 | 7/1984 | Muggleworth et al. | 416/215 |

FOREIGN PATENT DOCUMENTS

| | | | |
|---|---|---|---|
| 658445 | 4/1938 | Fed. Rep. of Germany | 416/215 |
| 1085643 | 4/1959 | Fed. Rep. of Germany | 416/215 |
| 656220 | 4/1929 | France | 416/219 R |
| 72222 | 6/1981 | Japan | 416/193 A |
| 5403 | 1/1983 | Japan | 416/191 |
| 347480 | 4/1931 | United Kingdom | 416/222 |
| 653267 | 5/1951 | United Kingdom | 416/248 |

*Primary Examiner*—Everette A. Powell, Jr.

*Attorney, Agent, or Firm*—Douglas S. Foote; Derek P. Lawrence

[57] ABSTRACT

The present invention discloses a turbomachinery blading configuration. The configuration includes a circumferential recess in a blade support structure and a plurality of blades. Each blade has a platform for mounting the blade within the recess. Each platform includes oppositely directed, generally circumferentially facing edges, each edge having a first and second axial surfaces separated by a recess. The surfaces contact matching surfaces on adjacent blades thereby determining predictable load paths for tangential and twisting moment reaction forces acting on the blades.

7 Claims, 3 Drawing Figures

BLADE PLATFORM

This invention is related to U.S. patent application Ser. No. 655,792—Kroger et al, filed Oct. 1, 1984, commonly assigned.

This invention relates generally to blading for turbomachinery and, more particularly, to a blade platform configuration for circumferentially loaded blades.

BACKGROUND OF THE INVENTION

Gas turbine engines generally include a gas generator with a compressor section for compressing air flowing through the engine, a combustor in which fuel is mixed with the compressed air and ignited to form a high energy gas stream, and a turbine section for driving the compressor. Many engines further include an additional turbine section located aft of the gas generator which drives a fan or propeller. In such engines, each of the turbines and compressor includes one or more bladed rows. Each bladed row includes individual blades mounted in a blade support structure as a rotor disk or casing.

Numerous blading configurations are known for mounting blades within such support structures. These configurations may be broadly classified into axially loaded blades and circumferentially loaded blades. Axially loaded blades typically include a platform and/or root portion at the base of the blade which is inserted and retained by a mating axial slot in the support structure. Circumferentially loaded blades typically include a platform and/or root which is inserted into and retained by a circumferential recess in the support structure.

Unlike axially loaded blades, circumferentially loaded blades generally contact each other within the circumferential recess. When such blades are subjected to the forces associated with the flow stream in the turbomachine, axial, tangential, and twisting moment forces are reacted between the blade platform and support structure and between adjacent blade platforms.

In prior art configurations, the platforms of circumferentially loaded blades contact adjacent blade platforms over a relatively broad surface area. Unless very small tolerances are maintained in machining the contact surfaces between such blades, non-uniform, concentrated loading between the blade platform and support structure and between adjacent blade platforms may occur. This concentrated loading may result in uneven wear and may necessitate premature removal and replacement of the blades as well as decreased operating efficiency caused by loose blades.

OBJECTS OF THE INVENTION

It is therefore an object of the present invention to provide a new and improved blade platform for a circumferentially loaded blade.

It is another object of the present invention to provide a new and improved blade platform for a circumferentially loaded blade with improved predictability of tangential and axial load distributions.

It is yet another object of the present invention to provide a new and improved turbomachinery blading configuration which reduces blade platform wear.

SUMMARY OF THE INVENTION

The present invention is an improved platform for a circumferentially loaded blade. The platform comprises oppositely directed, generally circumferentially facing edges. Each edge includes first and second axial surfaces separated by a relief.

In another form, the present invention is a turbomachinery blading configuration. This configuration comprises a circumferential recess disposed in a blade support structure. The configuration also comprises a plurality of blades. Each blade has a platform for mounting the blade within the recess. Each platform includes oppositely directed, generally circumferentially facing edges. Each of the edges has first and second axial surfaces separated by a relief. The surfaces contact matching surfaces on adjacent blades.

DETAILED DESCRIPTION OF THE INVENTION

Figure 1:
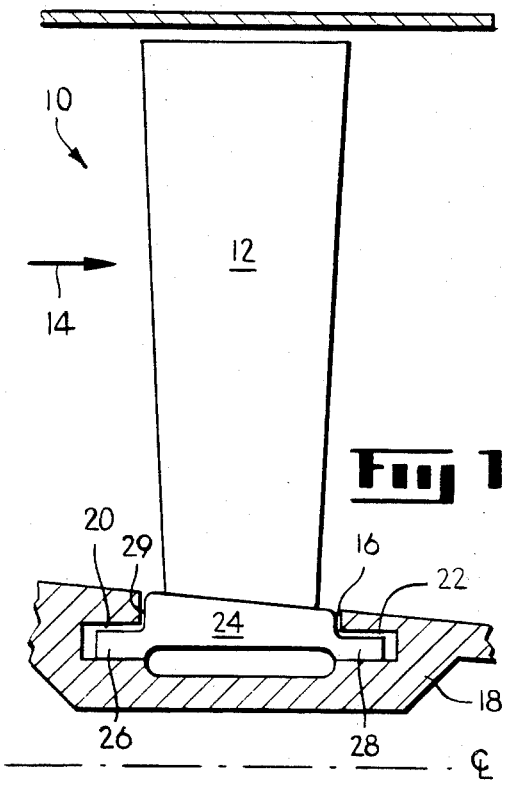
FIG. 1 is a partial side view of a turbomachinery blading configuration according to one form of the present invention.

FIG. 1 shows a turbomachinery blading configuration 10 according to one form of the present invention. Blading configuration 10 includes one or more blades 12 located in a flowpath 14. Blade 12 may be a rotating blade such as a turbine blade, compressor blade, or fan blade or a non-rotating stator in a turbomachine. Blading configuration 10 further includes a circumferential recess 16 in blade support structure 18. Blade support structure 18 may be a disk or an annular casing and may support radially outwardly directed blades 12, as shown. Alternatively, blade support structure 18 may be disposed radially outwardly with respect to flowpath 14 and support a plurality of blades extending radially inwardly.

Circumferential recess 16 includes axially opposite circumferential slots 20 and 22. Each blade 12 has a platform 24 with axial facing tangs 26 and 28 which are adapted to mate with slots 20 and 22, respectively.

Figure 2:
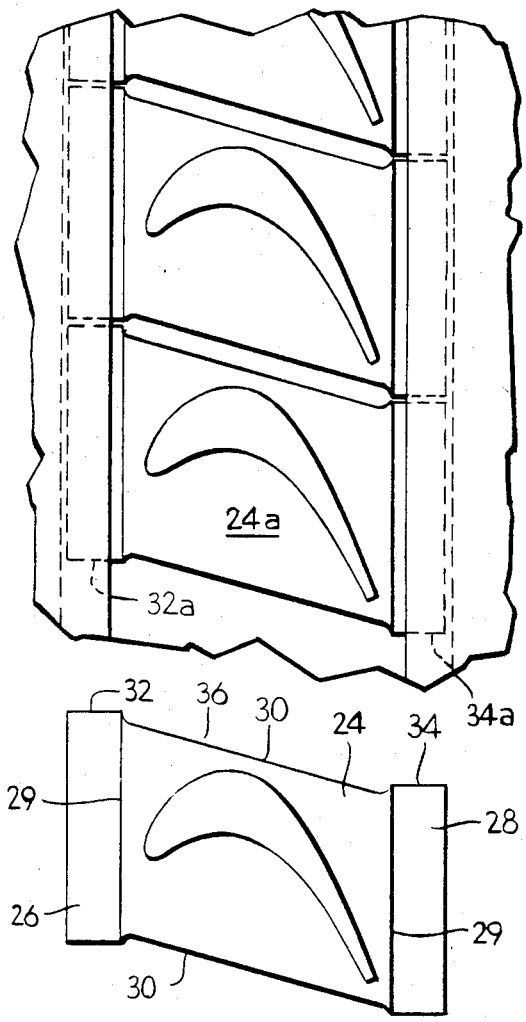
FIG. 2 is an exploded plan view of the configuration shown in FIG. 1.

As best shown in FIG. 2, each platform 24 for the circumferentially loaded blade 12 includes axial facing edges 29 and oppositely directed, generally circumferentially facing edges 30. Each edge 30 includes first and second axial surfaces 32 and 34 separated by a relief 36. Each of first and second axial surfaces 32 and 34 are disposed on tangs 26 and 28, respectively, of platform 24. Adjacent blade platforms 24 and **24*a* have similar configurations so that axial surfaces 32 and 34 contact matching surfaces 32*a* and 34*a***. In this manner, substantially all circumferential forces are transmitted through these surfaces.

Figure 3:
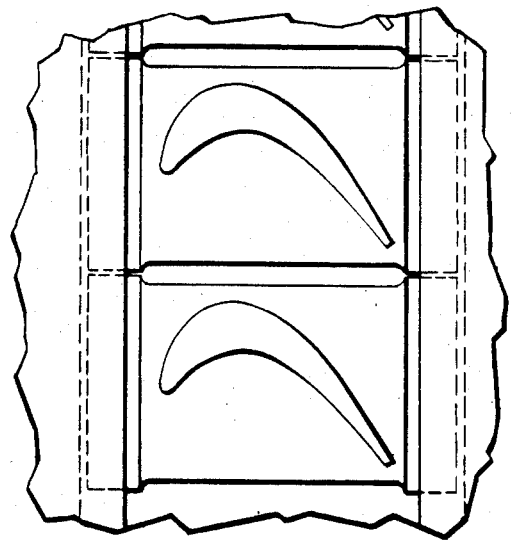
FIG. 3 is a view similar to that of FIG. 2 according to an alternative form of the present invention.
Figure 3:
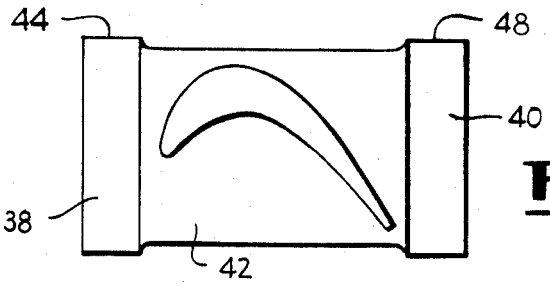

In the blading configuration shown in FIG. 2, tangs 26 and 28 are circumferentially offset. In this context, "circumferentially offset" refers to surfaces 32 and 34 being contained in separate radial planes. This results in platform 24 having a generally parallelogram shape. FIG. 3 shows an alternative embodiment of the present invention wherein tangs 38 and 40 are circumferentially aligned. In this context, "circumferentially aligned" means first and second axial surfaces 44 and 48 on platform 42 are generally coplanar. This gives blade platform 42 a generally rectangular shape. However, in both embodiments shown in FIG. 2 and FIG. 3, adjacent platforms mutually contact solely on axial surfaces.

In operation, each blade 12 will undergo axial, tangential, and twisting moment reaction forces. Axial forces will be transmitted into the support structure 18 and tangential forces will be transmitted through adjacent blade platforms 24 and eventually reacted by a tangential blade platform lock (not shown). By providing axial surfaces 32 and 34, moment forces will be reacted therethrough, although the relative magnitude of tangential forces through these surfaces will vary. In this manner and by closely controlling the tolerances of surfaces 32 and 34, the net load on each blade remains generally constant and is predictable. Uneven wear and fretting of platform edges 29, 32, and 34 is thereby reduced.

It will be clear to those skilled in the art that the present invention is not limited to the specific embodiments described and illustrated herein. Nor is the invention limited to blading configurations for rotors, but applies equally to stator blading configurations.

It will be understood that the dimensions and proportional and structural relationships shown in the drawings are illustrated by way of example only and those illustrations are not to be taken as the actual dimensions or proportional structural relationships used in the blade platform of the present invention.

Numerous modifications, variations, and full and partial equivalents can be undertaken without departing from the invention as limited only by the spirit and scope of the appended claims.

What is desired to be secured by Letters Patent of the United States is as follows.

What is claimed is:

1. A platform for a circumferentially loaded blade comprising: axially facing tangs for mounting said platform within a circumferential recess in a blade support structure, oppositely directed and generally circumferentially facing edges, each of said edges including first and second axial surfaces separated by a relief extending radially throughout said platform for contacting matching surfaces on adjacent blades, each of said first and second axial surfaces being disposed on said tangs, said relief being greater in axial length than said first and second axial surfaces for allowing substantially all circumferential forces acting on said platform to be transmitted solely through said surfaces.

2. A platform, as recited in claim 1, wherein said first and second surfaces of each edge are generally coplanar.

3. A platform, as recited in claim 1, wherein said first and second surfaces of each edge are circumferentially offset.

4. A turbomachinery blading configuration comprising: an annular casing with a circumferential recess disposed therein, said recess including axially opposite circumferential slots; and a plurality of blades, each having a platform with axially facing tangs adapted to mate with said slots; each of said tangs including circumferentially facing surfaces for contacting matching surfaces on adjacent blades, each of said surfaces being separated by a relief extending radially throughout said platform, said relief being greater in axial length than said first and second axial surfaces for allowing substantially all circumferential forces acting on said platform to be transmitted solely through said surfaces.

5. A configuration, as recited in claim 4, wherein adjacent platforms mutually contact solely on said surfaces.

6. A configuration, as recited in claim 4, wherein said tangs of each platform are circumferentially aligned.

7. A configuration, as recited in claim 4, wherein said tangs of each platform are circumferentially offset.

* * * * *